United States Patent [19]

Canale et al.

[11] Patent Number: 5,023,506

[45] Date of Patent: Jun. 11, 1991

[54] EXPLOSION PROOF HIGH PRESSURE DISCHARGE LAMP

[75] Inventors: Joseph E. Canale, Painted Post; John P. Dunn; William R. Narby, both of Hammondsport, all of N.Y.

[73] Assignee: North American Philips Corporation, New York, N.Y.

[21] Appl. No.: 458,111

[22] Filed: Dec. 28, 1989

[51] Int. Cl.[5] ..... H01J 61/34; H01J 17/28; H01J 17/34

[52] U.S. Cl. ..... 313/25; 313/623; 313/624; 313/625; 313/634; 362/377; 362/378

[58] Field of Search ..... 313/25, 573, 623, 624, 313/625, 634; 362/263, 267, 377, 378; 315/49, 56, 60

[56] References Cited

U.S. PATENT DOCUMENTS

| | | | |
|---|---|---|---|
| 4,281,274 | 7/1981 | Bechard et al. | 313/578 X |
| 4,539,510 | 9/1985 | Bouchard | 313/573 X |
| 4,625,140 | 11/1986 | Gragnon | 313/25 |
| 4,721,876 | 1/1988 | White et al. | 313/25 |
| 4,866,328 | 9/1989 | Ramaiah et al. | 313/25 |
| 4,950,938 | 8/1990 | Ramaiyah | 313/634 X |

*Primary Examiner*—Donald J. Yusko
*Assistant Examiner*—Ashok Patel
*Attorney, Agent, or Firm*—Brian J. Wieghaus

[57] ABSTRACT

A high pressure metal halide discharge lamp having a containment sleeve closed by a pair of metallic end caps for containing arc tube fragments in the event of explosive failure of the arc tube. Insulators secured in the end caps electrically insulate the arc tube lead-throughs from the end caps. Metallic tubes fixed on the lead-throughs butt against the insulators to secure the arc tube between the end caps and hold the end caps against the containment sleeve. Photoelectric emission from the end caps is avoided by electrically isolating the end caps or by providing a dielectric coating on end cap surfaces exposed to ultraviolet radiation.

19 Claims, 3 Drawing Sheets

EXPLOSION PROOF HIGH PRESSURE DISCHARGE LAMP

BACKGROUND OF THE INVENTION

Cross Reference to Related Application

This application is related to copending Ser. No. 07/548,112, filed simultaneously herewith on Dec. 28, 1989, entitled "High Pressure Discharge Lamp Having Improved Containment Structure" of Tjitte De Jong, Florentinus L. Bens and Danny L. Hermans which discloses and claims a high pressure discharge lamp having a tubular outer envelope and a double-walled containment sleeve closed at both ends by respective metal end caps which engage the wall of the outer envelope.

Field of the Invention

The present invention relates to high-pressure discharge lamps, and more particularly to metal halide high-pressure discharge lamps having a discharge vessel arranged within an outer envelope and structure for containing discharge vessel fragments in the event of discharge vessel rupture.

High-pressure discharge lamps which include a metal halide in the ionizable material are well known. These lamps typically have an ionizable material comprising mercury, a sodium halide and a metal halide contained within a discharge vessel. During lamp operation the ionizable material is vaporized and partially ionized by an electrical discharge through the vaporized material within the discharge vessel to emit light. Ultraviolet radiation is also produced by the discharge. The internal pressure within the discharge vessel is greater than one atmosphere and typically several atmospheres.

Because of the high internal pressure within the discharge vessel, care is taken to design the vessel to withstand such pressures. Notwithstanding good design practice applied to the discharge vessel, on occasion one may fail. If the discharge vessel ruptures, the pressure differential to which fragments of the discharge vessel are subjected can accelerate the fragments with sufficient force to penetrate the lamp outer envelope, causing a serious hazard to persons or property in the immediate surroundings of the lamp.

The explosive failure of a discharge vessel is unpredictable. Although its occurrence is rare, the consequences of such failure are often serious. Therefore, protective measures must be taken.

Description of the Prior Art

A common measure taken for preventing discharge vessel fragments from escaping the lamp has been to provide a tubular shield, such as a cylindrical glass sleeve and/or wire mesh, around the discharge vessel.

U.S. Pat. No. 4,281,274 (Bechard et al) discloses a lamp having a typical quartz, discharge vessel, or arc tube, used in metal halide lamps and a cylindrical glass sleeve open at both ends axially aligned with the arc tube and surrounding it. The cylindrical sleeve is a borosilicate hardglass. The patent discloses that the hard glass sleeve performs three functions: temperature control, fragment containment, and ultraviolet radiation shielding. British patent specification 495,978 accepted Nov. 23, 1939 (based on application No. 16451/37 dated June 14, 1937) also shows the use of a thick auxiliary glass sleeve to provide rupture protection in a high pressure metal vapor discharge lamp.

U.S. Pat. No 4,721,876 discloses that a single glass sleeve is often inadequate. Upon rupture of the arc tube, the single glass sleeve is itself shattered, allowing fragments from the arc tube and the sleeve to strike the outer envelope, resulting in its failure. To overcome the limited protection provided by a single glass sleeve, U.S. Pat. No. 4,721,876 discloses a woven wire mesh which surrounds the glass sleeve to contain fragments from the arc tube and the glass sleeve in the event of an explosive failure of the arc tube.

As an alternative to a wire mesh surrounding a single glass sleeve, U.S. Pat. No. 4,797,334 (Keeffe et al) discloses a high pressure discharge lamp having an outer envelope with a thickness greater than a standard envelope to contain glass fragments in case of rupture of both the arc tube and the glass sleeve. This lamp has the disadvantage that a non-standard, and thus more expensive, outer envelope is used.

The above lamp designs for rupture protection have the common disadvantage that the containment sleeves surrounding the arc tube are open at both ends. It has been found that glass fragments from an exploding arc tube will occasionally escape out the open ends of such containment sleeves and strike the neck or dome portion of the outer envelope, causing hazardous failure of the outer envelope. Because of the incomplete containment provided by the prior art lamps, metal halide lamps are normally operated in fixtures or luminaires which are enclosed to contain fragments in the event of explosive lamp failure. Such precautions have been necessary to protect against personal injury and property damage.

Additionally, the containment sleeves in the prior art have generally been supported by thin metallic bands surrounding the glass sleeves and welded to frame structure within the lamp. This construction has made it difficult to support the sleeve concentric with the discharge vessel. Inaccurate positioning of the sleeve can lead to failure of the sleeve, and the lamp, since portions of the sleeve positioned closer to an exploding discharge vessel may fail.

Additionally, when providing containment structure within the outer lamp envelope in metal halide discharge lamps, care must be taken to avoid increased photoelectron production. The cause of photoelectron production is well documented. (See, for example, Waymouth, Electric Discharge Lamps, MIT Press, Com. Section 10.5). Ultraviolet radiation from the arc tube striking metallic parts within the lamp envelope causes emission of photoelectrons from the metallic parts.

Photoelectron emission is very detrimental in lamps such as metal halide discharge lamps, having a quartz glass arc tube, which contains during lamp operation an ionized plasma of mercury, sodium, a halogen such as iodine, and other metals such as thallium. Sodium ions have a high rate of diffusion through heated quartz. The photoelectrons collect on the outer surface of the arc tube creating a negative potential that attracts the positive sodium ions and accelerates their diffusion through the arc tube wall. The production of photoelectrons substantially accelerates the depletion of sodium within the arc tube, causing premature lamp voltage rise, and thus shortens the useful life of the lamp.

One method of reducing photoelectron emission is to shield metal parts within the lamp from ultraviolet radiation. Fused quartz glass tubes, or ceramic tubes comprised of alumina and silica, are often used for shielding. However, such materials are only useful for covering metal structure which is straight because the ceramic or glass tubes must be straight. Alternatively, U.S. Pat. No. 4,866,328 (Ramaiah et al) discloses that a layer of zirconia oxide may be applied to curved metal parts to reduce photoelectron emission from those parts.

Another method for reducing photoelectron emission is to ensure wherever possible that metal parts exposed to ultraviolet radiation, or other parts adjacent the arc tube, do not carry a negative charge. For example, Bechard et al (U.S. Pat. No. 4,281,274) teaches that the hard glass containment sleeve must be electrically biased with a positive charge in order to minimize the loss of sodium from the discharge vessel.

Still another method is to mount any metal parts or glass shields in an electrically isolated condition. U.S. Pat. No. 4,950,938 (Ramaiah) discloses that a lamp having a cylindrical metal containment grid mounted in an electrically isolated condition exhibits reduced sodium loss over shields in which a positive electrical potential is applied according to U.S. Pat. No. 4,281,274. The electrically isolated grid exhibits diminished photoelectron production because a static positive potential develops on the isolated metal grid until the grid potential is just sufficient to prevent any further ejection of photoelectrons.

SUMMARY OF THE INVENTION

An object of the invention is to provide a high pressure discharge lamp which provides complete containment of the discharge vessel in the event of explosive rupture, permitting the lamp to be operated in an open fixture or luminaire.

It is another object of the invention to provide, in a high-pressure discharge lamp having a containment sleeve circumferentially surrounding the arc tube and open at both ends, closing means for closing the open ends of the sleeve to contain fragments which would otherwise escape out the ends of the sleeve upon explosive rupture of the discharge vessel.

It is also an object of the invention to provide a lamp in which the closing means comprises structure which is attachable to frame parts within the lamp for holding the sleeve.

It is another object of the invention to provide a lamp in which the structure for closing the sleeve ends also supports the arc tube symmetrically within the containment sleeve.

It is yet another object of the invention to provide a lamp in which increased photoelectron production from the provision of the closing structure is prevented.

The high-pressure discharge lamp according to the invention has a discharge vessel, or arc tube, mounted within an outer envelope. The discharge vessel has a pair of sealed ends and contains an ionizable fill material. Means for ionizing the fill material within the discharge vessel permits ionization of the fill material to emit light. The ionized fill material develops a pressure exceeding one atmosphere during lamp operation. A containment sleeve circumferentially surrounds and extends the length of the discharge vessel, and has opposing open ends each adjacent a sealed end of the discharge vessel. A pair of end caps are provided for closing the open ends of the containment sleeve. The end caps have sufficient mechanical strength for containing fragments which would otherwise escape out the open ends of the containment sleeve.

According to an embodiment of the invention, the end caps are metallic. The discharge vessel has a pair of electrodes disposed therein and lead-throughs extending from the electrodes through the sealed ends. Current-supply conductors are connected to the arc tube lead-throughs for energizing the arc tube to emit light. The lead-throughs pass through the metallic end caps and insulating means are provided for electrically insulating the lead-throughs from the end caps.

The end caps preferably are secured to a common support extending within the envelope and have means for holding the ends of the containment sleeve for securing the sleeve between the end caps. The holding means may comprise a plurality of projections engaging the ends of the containment sleeve.

It is also advantageous if the end caps secure the arc tube concentrically with the containment sleeve between the end caps and if the end caps are rigidly secured to the containment sleeve so that the arc tube, containment sleeve, and end caps can be welded as a subassembly to the metallic support.

According to a preferred embodiment, the above features are combined in a simple manner. Each end cap has central aperture in which an insulative member is disposed. The arc tube lead-throughs extend through bores centered in the insulative members, insulating the lead-throughs from the end caps. The insulative members are preferably ceramic bushings having a shoulder which butts against the side of the end cap facing away from the arc tube. Metallic tubes are welded on the portions of the lead-throughs extending outside the end caps and have ends which butt against the ceramic bushings for securing the arc tube between the end caps. The metallic tubes welded to the lead-throughs hold the insulative bushings against the end caps and the end caps against the containment sleeve, and support the arc tube between the end caps symmetrically with the sleeve.

The containment sleeve may consist of a single tubular glass sleeve, a tubular wire grid, or a glass sleeve enclosed by a wire grid or mesh. According to the preferred embodiment, the containment sleeve consists of a pair of concentric glass sleeves. The inner tube preferably consists of quartz glass and the outer tube consists of a borosilicate hard glass.

According to a first embodiment, the metallic support to which the end caps are welded is electrically isolated from the current-supply conductors connected to the lead-throughs. The end caps are electrically insulated from the current-supply conductors and arc tube lead-throughs by the insulative members. Since the metallic end caps are electrically isolated, no substantial acceleration in sodium loss from the discharge vessel is encountered. Photoelectron emission from the end caps is limited because the end caps accumulate positive charges until a stable positive shield potential is developed sufficient to prevent any further ejection of photoelectrons, as described in U.S. application Ser. No. 07/272,181 filed Nov. 16, 1988.

The rigid metallic support to which the end caps are welded may have one end embedded in the stem, forming a three-lead stem, or may be secured to the stem via a metal band surrounding the stem.

According to a second embodiment, the rigid conductor to which the end caps are welded is connected to a lead-through of the arc tube and carries current for energizing the arc tube. The end caps have a dielectric coating on the surfaces which are in view of the arc tube and on which ultraviolet radiation from the arc tube is incident. The use of a dielectric coating eliminates photoelectron emission from the end caps and obviates the need for a separate support mounted in an electrically isolated condition.

BRIEF DESCRIPTION OF THE DRAWINGS

FIG. 1*b* shows a detailed section of the end cap, ceramic bushing, and arc tube lead-through.

DESCRIPTION OF THE PREFERRED EMBODIMENTS

Figure 1A:
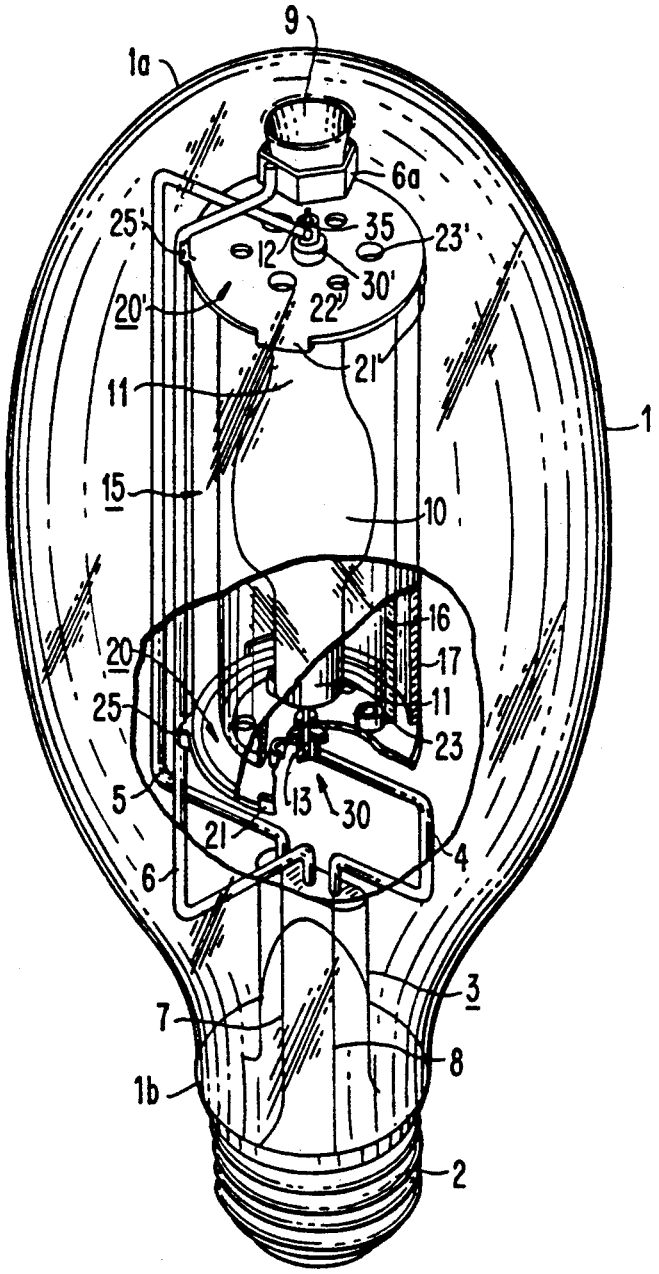
FIG. 1*a* is a perspective view of a metal halide discharge lamp according to a first embodiment of the invention in which the end caps are fixed to an electrically isolated metallic support extending within the outer envelope.
Figure 1B:
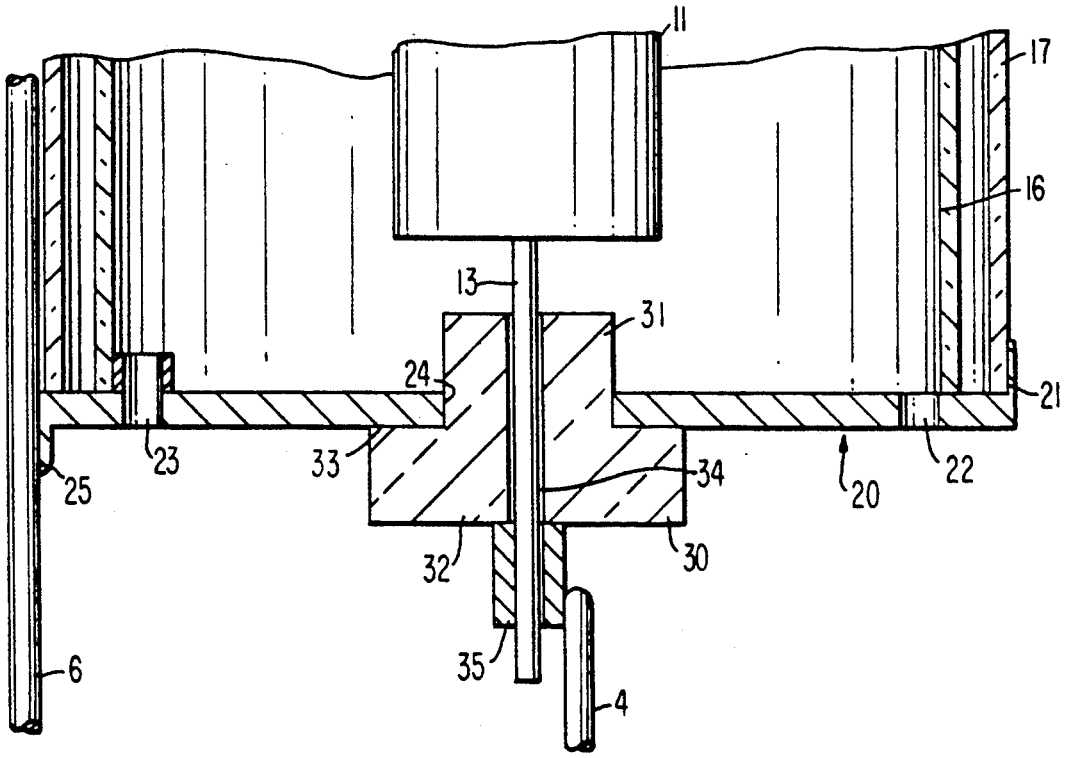

FIGS. 1 shows a metal halide discharge lamp according to the invention having a formed-body quartz arc tube 10 which is arranged within a standard bulged tube end-dimpled (BD) outer envelope 1 which carries a standard mogul base 2. The quartz arc tube has a pair of sealed ends 11 through which molybdenum current lead-throughs 12, 13 extend in a gas-tight manner. The lead-throughs are connected to standard discharge electrodes arranged within the arc tube, not shown. The lamp has an ionizable fill comprising mercury, a sodium halide, and one or more metal halides. The arc tube structure and its operation are conventional.

During normal lamp operation the arc tube 10 typically develops high internal pressures of several atmospheres. If the arc tube fails, the high internal pressure will outwardly accelerate hot fragments of the arc tube with sufficient velocity to penetrate the outer envelope 1. Containment structure consisting of a containment sleeve 15 and end caps 20, 20' is provided in order to contain the arc tube fragments in the event of explosive rupture of the arc tube.

The containment sleeve is preferably comprised of a pair of concentric glass cylinders 16, 17 having a length greater than that of the arc tube 10 and open at both ends. The inner glass cylinder 16 consists of a quartz glass to withstand the high heat from the arc tube and to prevent cracking of the inner sleeve by thermal shock in the event the arc tube bulges during the life of the lamp and contacts the inner sleeve. The outer cylinder 17 consists of a borosilicate hard glass for improved containment and for filtering ultraviolet radiation from the arc tube. The end caps 20, 20' are provided in order to contain fragments which would otherwise escape out the open ends of the containment sleeve and strike the outer envelope near the dome portion 1a or neck portion 1b.

In addition to the containment function, the end caps also have a plurality of projections for centering and supporting the glass sleeves 16, 17. The end caps have a plurality of tabs 21, 21' on their outer peripheral edge which uniformly contact the outer surface of the outer glass cylinder 17. Each end cap also has a plurality of pierced extruded holes 22 which form circular flanges 23. The holes are located such that the flanges 23 contacts the inner surface of the inner glass cylinder 16. The tabs 21, 21' and flanges 23, 23' secure the glass sleeves against transverse movement.

Each end cap also has a central aperture 24 in which a respective insulative member 30 is disposed. The insulative member is a ceramic bushing having a bore 34 therethrough. Lead-throughs 13 are aligned with axis of the arc tube 10 and extend through the bores 34, electrically insulated from the end caps. Each ceramic bushing has a cylindrical portion 31 sized for insertion through aperture 34, and a button portion 32 forming a shoulder 33 which butts against the side of the end cap facing away from the arc tube. Metallic tubes 35 are disposed on the end portions of the lead-throughs which extend past the ceramic bushings 30. The metallic tubes 35 are welded to the lead-throughs and have ends which butt against the ceramic bushings to secure the bushing shoulder 33 against the end caps and hold the glass sleeves 16, 17 between the end caps. The arc tube 10 is also secured between the end caps by reason of the tubes 35 being welded to the lead-throughs 12, 13 and butting against the bushing 30. The apertures 24 and bores 34 are centered with respect to the tabs 21 and flanges 23, ensuring that the arc tube is concentric with the sleeves 16, 17.

In addition to securing the inner glass cylinder, the holes 22, 22' allow convection currents to circulate through the end caps and around the arc tube 10 to prevent overheating, of the arc tube during lamp operation. The holes 22, 22' are sized small enough to contain fragments from an exploding arc tube which are of a size large enough to cause failure of the outer envelope.

The lamp has a three-lead stem assembly comprising a stem press 3, which seals the envelope in a gas-tight manner, and two rigid metallic conductors 4, 5, and metallic support 6, which have ends embedded in the stem press. The conductors 4, 5 and support 6 consist of nickel or nickel-plated iron. The rigid conductors 4, 5 are each electrically connected to respective contact portions of the lamp cap 2 by conductive wires 7, 8 which extend through the stem press in a gas-tight manner. The rigid conductors 4 is connected to the lead-through 13 closest to the lamp cap and the rigid conductor 5 is connected to the lead-through furthest from the lamp cap. The metallic tubes 35 may consist of nickel and, in addition to preventing movement of the ceramic bushings, also serve as flux material for welding of the lead-throughs to the rigid conductors 4, 5. Alternatively, the tubes 35 may consist of amaloy and be crimped to the lead-throughs and welded to the conductors 4, 5. The metallic support 6 is secured at its end opposite the lamp stem to dimple 9 of the outer envelope 1 via metallic ring 6*a*. The end caps are welded at flanges 25 to the support 6. The metallic support 6 is electrically isolated from the conductors 4, 5, which supply current to the arc tube. Instead of having an end embedded in the lamp stem, the support 6 may be secured near the lamp base, for example, by a metallic strap surrounding the lamp stem.

During lamp manufacture, the arc tube and containment sleeve are easily secured to the lamp frame since they may be pre-assembled as a subassembly consisting of the arc tube 10, sleeves 16, 17, end caps 20, 20' ceramic bushings 30 and metallic tubes 35. The subassembly is secured to the support 6 simply by welding the end caps to the support. The lead-throughs 12, 13 are electrically connected to the conductors 4, 5 simply by spot welding the tubes 35 to the ends of the conductors 4, 5.

During lamp operation, photoelectron emission from the metallic end caps is limited since the end caps are electrically isolated by reason of being welded to the electrically isolated support 6 and being insulated from the lead-throughs 13 by the ceramic bushings 30. Upon starting of the lamp, photoelectrons will initially be ejected from the end caps as ultraviolet radiation from the arc tube strikes the end caps. However, each time a photoelectron is emitted a net positive charge is developed on the end cap. These positive charges accumulate on the end caps until the end caps have a stable positive static potential high enough to prevent further emission of photoelectrons. While some of the positive charge may be dissipated from the end caps due to leakage, allowing the emission of further photoelectrons, the photoelectron flux is low. Accelerated sodium loss from the arc tube by the provision of metallic end caps is thus avoided.

The metallic conductors 4, 5, and support 6 are not a problematic source of photo-electrons during lamp operation because the end caps 20, 20' and the borosilicate sleeve 17 sufficiently block or filter ultraviolet radiation from the arc tube.

Figure 2:
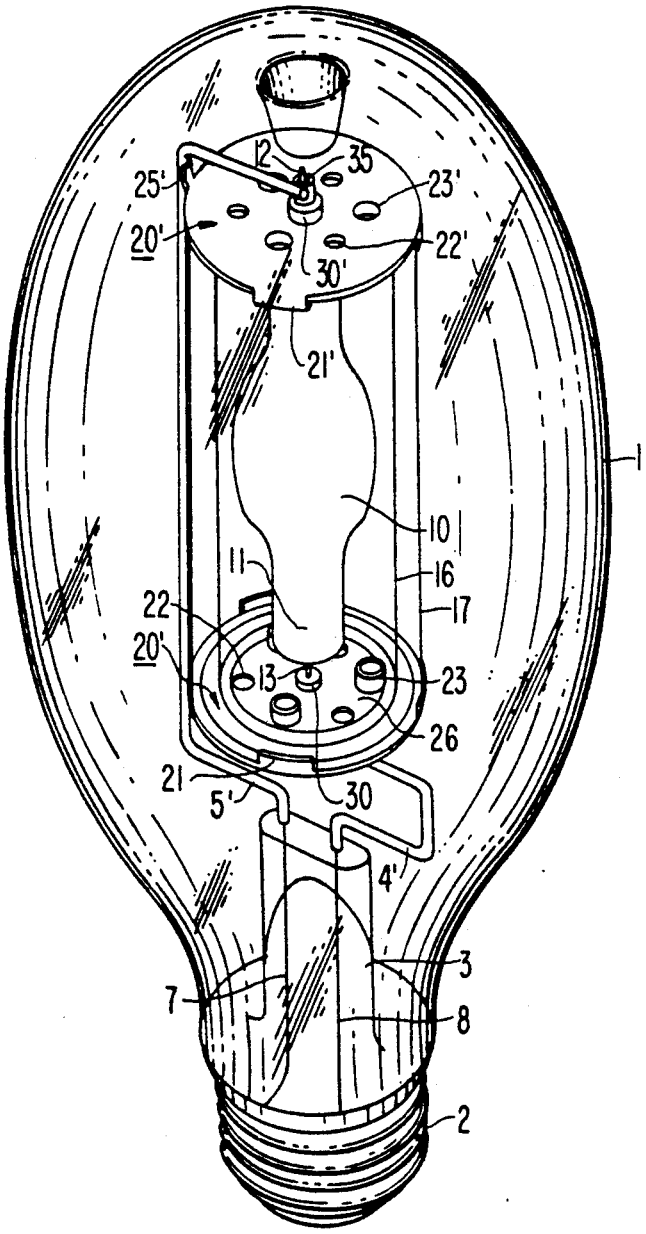
FIG. 2 illustrates a metal halide lamp according to a second embodiment of the invention in which the metallic support to which the end caps are welded carries electric current to the discharge vessel.

FIG. 2 illustrates a second embodiment of the invention in which the lamp has only a two-lead stem. The end caps 20, 20' are directly welded to the rigid current-carrying conductor 5' which is electrically connected to the lead-through 13 and tube 35 on the side of the arc tube furthest from the lamp cap. To overcome the problem of photoelectron emission from the end caps, the end caps 20' have a coating 26 of dielectric material at least on the surfaces which face the arc tube and are exposed to ultraviolet radiation. The coating is a barrier to UV radiation, thus preventing the emission of photoelectrons from the end caps and avoiding accelerated sodium loss from the arc tube. A preferred material is zirconia oxide, disclosed in U.S. Pat. No. 4,866,328. Other suitable materials include a high quartz alumina, alumina silica, and yttria stabilized zirconia.

Those of ordinary skill in the art will appreciate that many variations of the disclosed lamp are possible which would fall within the scope of the invention. For example, other embodiments of the tubular rupture barrier 15 may be substituted for the cylindrical glass tubes 16, 17 described above. A single glass sleeve or a glass sleeve which is further enclosed by a wire mesh may be used. Alternatively, a tubular wire grid formed, for example, from 0.006 in to 0.010 stainless steel wire as described in U.S. application Ser. No. 272,181, filed Nov. 16, 1988, may be used. These other sleeve configurations may readily be supported between end caps.

In metal halide lamps having a power greater than 70 watts, the quartz arc tube generally has a tubular body with pinch seals at both ends. Since such an arc tube would have lead-throughs extending through the pinch seals, the same construction of an insulative bushing and metal tubes welded on the lead-throughs can be used to support the arc tube between the end caps. Alternatively, other structure for holding the arc tubes, such as each end cap having resilient tabs for holding a respective pinch seal, are feasible.

Additionally, the rigid conductors 4, 5 according to the first embodiment or conductor 4' according to the second embodiment may be replaced by non-rigid field wires for energizing the arc tube since support for the arc tube is provided by the end cap assemblies and support 6 of the first embodiment or rigid current-carrying conductor 5' of the second embodiment.

What is claimed:

1. In a high pressure discharge lamp having an outer envelope, a discharge vessel within said outer envelope having an ionizable fill material, means for ionizing said fill material within said discharge vessel to emit light wherein said fill material develops a pressure within said discharge vessel in excess of one atmosphere, the improvement comprising:

containment means enclosing said discharge vessel for containing fragments from said discharge vessel in the event of an explosive rupture of said discharge vessel, said containment means comprising a containment sleeve circumferentially surrounding said discharge vessel for the length of said discharge vessel and having opposing open ends, and a pair of end caps each covering an open end of said containment sleeve for containing discharge vessel fragments which would otherwise escape out the open ends of said containment sleeve and impinge on said outer envelope.

2. In a high pressure discharge lamp according to claim 1, further comprising a metallic support extending within said outer envelope; and said end caps being metallic and comprising holding means for holding said ends of said containment sleeve, said end caps being fixed to said metallic support.

3. In a high pressure discharge lamp according to claim 2, wherein said means for ionizing said fill material comprises conductive lead-throughs extending from said discharge vessel through said metallic end caps, and/ insulating means for electrically insulating said conductive lead-throughs from said metallic end caps.

4. In a high pressure discharge lamp according to claim 3, securing means for securing said discharge vessel to said metallic end caps positioned concentric with said containment sleeve.

5. In a high pressure discharge lamp according to claim 4, wherein sodium ions are diffusible through said discharge vessel during lamp operation and said ionizable fill material comprises sodium; and said metallic end caps and said metallic support being mounted in an electrically isolated condition to permit a stable positive potential to be developed on said metallic end caps sufficient to suppress photoelectron production, whereby the presence of said metallic end caps does not promote sodium loss from said discharge vessel.

6. In a high pressure discharge lamp according to claim 4, wherein sodium ions are diffusible through said discharge vessel during lamp operation and said ionizable fill material comprises sodium;

said means for ionizing said fill material comprises said metallic support being connected to one of said lead-throughs for carrying electric current to said discharge vessel during lamp operation; and said metallic end caps have a dielectric coating on surfaces facing said discharge vessel for shielding said end caps from ultraviolet radiation from said discharge vessel, whereby the presence of said metallic end caps does not promote sodium loss from said discharge vessel.

7. In a high pressure discharge lamp according to claim 4, wherein said holding means comprises said metallic end caps having a plurality of projections for engaging said ends of said containment sleeve, said insulating means comprises each metallic end cap having and aperture with an insulative member disposed therein, said lead-throughs extending through said insulative members insulated from said arc tube, and said securing means comprises each insulative member having a shoulder butting against the surface of said metallic end cap facing away from said arc tube, and a metallic tube fixed on each lead-through and having an end butting against said insulative member for holding said insulative member against said metallic end cap and said end cap against said containment sleeve ends, and securing said arc tube between said end caps.

8. In a high pressure discharge lamp according to claim 2, wherein sodium ions are diffusible through said discharge vessel during lamp operation and said ionizable fill material comprises sodium; and said metallic end caps and said metallic support being mounted in an electrically isolated condition to permit a stable positive potential to be developed on said metallic end caps sufficient to suppress photoelectron production, whereby the presence of said metallic end caps does not promote sodium loss from said discharge vessel.

9. In a high pressure discharge lamp according to claim 3, wherein sodium ions are diffusible through said discharge vessel during lamp operation and said ionizable fill material comprises sodium;

said means for ionizing said fill material comprises said metallic support being connected to one of said lead-throughs for carrying electric current to said metallic discharge vessel during lamp,,operation; and said metallic end caps have a dielectric coating on surfaces facing said discharge vessel for shielding said end caps from ultraviolet radiation from said discharge vessel, whereby the presence of said metallic end caps does not promote sodium loss from said discharge vessel.

10. A high pressure metal halide discharge lamp having an outer envelope, a quartz glass discharge vessel arranged within said outer envelope, said discharge vessel having sealed ends sealing said discharge vessel in a gas-tight manner, a pair of discharge electrodes arranged with said discharge vessel, a pair of lead-throughs each connected to a respective electrode and extending through a respective sealed end to the exterior, and an ionizable fill material within said discharge vessel comprising mercury, sodium, and a metal halide, said ionizable fill material developing a pressure of greater than one atmosphere during lamp operation, wherein the improvement comprises:

a containment sleeve circumferentially surrounding and extending the length of said discharge vessel for containing fragments of said discharge vessel in the event of an explosive failure of said discharge vessel, said containment sleeve having opposing open ends each adjacent a respective sealed end of said discharge vessel;

a pair of metallic end caps for holding a respective open end of said containment sleeve, said end caps having sufficient mechanical strength for containing fragments of said discharge vessel which would otherwise escape out said open ends of said containment sleeve and impinge on said outer envelope, each end cap having a central aperture;

a pair of insulative members disposed in said end cap apertures, each insulative member having a bore through which a respective discharge vessel lead-through extends, said insulating members electrically insulating said lead-throughs from said ends caps; and a metallic support extending longitudinally within the lamp envelope, each of said end caps being fixed to said metallic support with said containment sleeve extending between and held by said end caps, said discharge vessel being enclosed by said containment sleeve and said end caps, and energizing means for energizing said discharge vessel to ionize said fill material to emit light.

11. A lamp as claimed in claim 10, wherein each insulative member comprises a shoulder engaging the surface of said metallic and caps remote from said discharge vessel, and a metallic tube welded on each lead-through having ends butting against said insulative members for mechanically securing said insulative members against said end caps, said end caps against said containment sleeve, and said discharge vessel between said end caps.

12. A lamp as claimed in claim 11, wherein said containment sleeve comprises a pair of concentric tubular glass sleeves, the inner glass sleeve closest to said discharge vessel consisting essentially of quartz glass and the outer glass sleeve consisting essentially of borosilicate glass.

13. A lamp as claimed in claim 12, wherein said metallic end caps have a first plurality of projections engaging the outer surface of said outer glass sleeve and a second plurality of projections engaging the inner surface of said inner glass sleeve for holding said inner and outer glass sleeves between said end caps.

14. A lamp as claimed in claim 13, wherein said energizing means comprises current-supply conductors extending from said lamp stem each connected to a respective discharge vessel lead-through, and means for mounting said metallic support in an electrically isolated condition from said current-supply conductors to permit a stable positive potential to be developed on said metallic end caps during lamp operation sufficient to suppress photoelectron production, whereby the presence of said metallic end caps does not promote sodium loss from said discharge vessel.

15. A lamp as claimed in claim 13, wherein said means for energizing said discharge vessel comprises said metallic support and another conductor connected to said discharge vessel lead-throughs for carrying electric current to said discharge vessel during lamp operation, said metallic end caps having a dielectric coating on surfaces in view of said discharge vessel for preventing photoelectron emission from said end caps during lamp operation.

16. A lamp as claimed in claim 10, wherein said containment sleeve comprises a pair of concentric tubular galss sleeves, the inner glass sleeve closest to said discharge vessel consisting essentially of quartz glass and the outer glass sleeve consisting essentially of borosilicate glass.

17. A lamp as claimed in claim 16, wherein said end caps have a first plurality of projections engaging the outer surface of said outer glass sleeve and a second plurality of projections engaging the inner surface of said inner glass sleeve for holding and centering said inner and outer glass sleeves between said end caps.

18. A lamp as claimed in claim 10, wherein said energizing means comprises current-supply conductors extending from said lamp each connected to a respective discharge vessel lead-through, and means for mounting said metallic support in an electrically isolated condition from said current-supply conductors to permit a stable positive potential to be developed on said metallic end caps during lamp operation sufficient to suppress photoelectron production, whereby the presence of said metallic end caps does not promote sodium loss from said discharge vessel.

19. A lamp as claimed in claim 10, wherein said means for energizing said discharge vessel comprises said metallic support and another conductor connected to said discharge vessel lead-throughs for carrying electric current to said discharge vessel during lamp operation, and said metallic end caps having a dielectric coating on surfaces in view of said discharge vessel for preventing photoelectron emission from said end caps during lamp operation.

* * * * *